United States Patent [19]
Kauer et al.
[11] 4,326,447
[45] Apr. 27, 1982

[54] DEVICE FOR THE POSITIONING AND POSITION STABILIZATION OF AN INERT MASS, POSITIONED WITH MOBILITY ON A BASE

[75] Inventors: Harald Kauer, Ettlingen; Knud Overlach; Joachim Wilken, both of Karlsruhe, all of Fed. Rep. of Germany

[73] Assignee: Dr.-Ing. Ludwig Pietzsch, Karlsruhe, Fed. Rep. of Germany

[21] Appl. No.: 603,594

[22] Filed: Aug. 8, 1975

Related U.S. Application Data

[63] Continuation-in-part of Ser. No. 349,660, Apr. 3, 1973, abandoned.

[51] Int. Cl.[3] ..... F41G 5/24
[52] U.S. Cl. ..... 89/41 H; 74/378; 192/21; 318/649

[58] Field of Search ..... 89/37.5 A, 41 M, 41 LE, 89/41 H; 192/3.57, 3.58, 87.13–87.19, 21; 318/616, 617, 649; 74/378

[56] References Cited

U.S. PATENT DOCUMENTS 2,938,435 5/1960 Gille ..... 89/41 M

*Primary Examiner*—Stephen C. Bentley
*Attorney, Agent, or Firm*—L. Lawton Rogers, III

[57] ABSTRACT

System for positioning and maintaining position stabilization of a mass such as a barrelled gun supported on a base such as a tracked vehicle. The system employs oppositely rotating disks with fluid actuated clutches for moving the gun barrel mass in a single degree of freedom as determined by a deviation from a predetermined setting.

7 Claims, 3 Drawing Figures

DEVICE FOR THE POSITIONING AND POSITION STABILIZATION OF AN INERT MASS, POSITIONED WITH MOBILITY ON A BASE

RELATED APPLICATION

This application is a continuation-in-part of application Ser. No. 349,660, filed Apr. 3, 1973, now abandoned.

BACKGROUND OF THE INVENTION

This invention concerns a device for positioning and stabilizing of the position of an inert mass, positioned in mobile fashion on a base in at least one degree of freedom. A regulating installation provides settings whose number coincides with the number of degrees of freedom. Such a device may, for example, be employed for stabilizing and targeting a barrelled weapon whose center of gravity is positioned on a tracked vehicle on a steady or moving target. The base in this connection is the body of the tracked vehicle and the inert mass is the barrelled weapon.

One device of this kind is known, where deviations of the barrelled weapon from the desired direction are compensated for via a directional drive which is coupled with the barrelled weapon when movements of the body occur. The reaction impulse of the directional drive is directly derived from the body. Hereby disturbing movements of the body are transferred directly via the directional drive to the barrelled weapon, which have to be compensated. Such disturbing movements are for example the movements of the vehicle body when the tracked vehicle traverses uneven road surfaces.

The invention provides a system of the kind mentioned at the outset, with which, independently of the disturbing movements of the base, a rapid and precise positioning and position stabilization of the mass is possible. To carry out the assignment it is provided, according to the invention, that every setting is produced by the pressing of at least one first part arranged at the mass against at least one second part, which is attached to the base and is moved in relation to the first part, in the form of friction forces, such for example as friction impulses.

With the system according to the invention the barrelled weapon once aimed is uncoupled of the base and is therefore not influenced by disturbing movements of the base. The barrelled weapon which may be supported at the base in low friction bearings, is then held correctly aimed alone by its inertia without being influenced by any disturbing movements of the base.

Since the friction values in the case of the respective friction pairs are independent of the speed of the relative movement between the two parts, the device according to the invention can be used to produce, through regulation of the pressing force, defined forces such as impulses as settings, which accelerate the mass independent of the movements of the base or vehicle body in the direction of the desired position, and which brake it when the position is reached.

The motion speed of the one part for this purpose must be at least as great as for instance the movements of the base.

Appropriately one part is a rotating disk and the other part a friction cushion which can be pressed against it, whereby the disk may be placed on the base and be constantly driven, while the friction cushion is mounted to the mass.

In a preferred execution of the invention a pair of counter-rotating disks is provided for every degree of freedom, to each of which a friction cushion is assigned, which can be operated separately from the other friction cushions, depending on the direction in which the mass or barrelled weapon is supposed to be carried along.

Further embodiments of the device are explained in detail in the supplementary claims and in the following description of an execution example, on the basis of schematic drawings.

THE DETAILED DESCRIPTION

Figure 3:
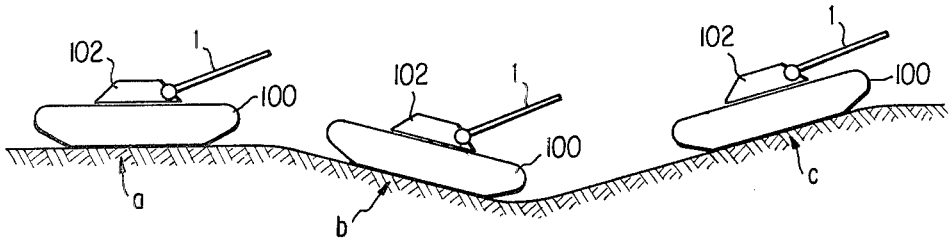
FIG. 3 is a side view of different positions of a vehicle using the present invention.

FIG. 3 shows a track type vehicle 100 in positions (a), (b) and (c) as it moves over uneven terrain. The vehicle has a base portion 102 on which a barrelled weapon 1 is supported. The elevation of the weapon is stabilized by the present invention. As a result, the angle the barrel makes with the horizontal remains the same irrespective of whether the vehicle is level, moving downhill or moving uphill.

Figure 1:
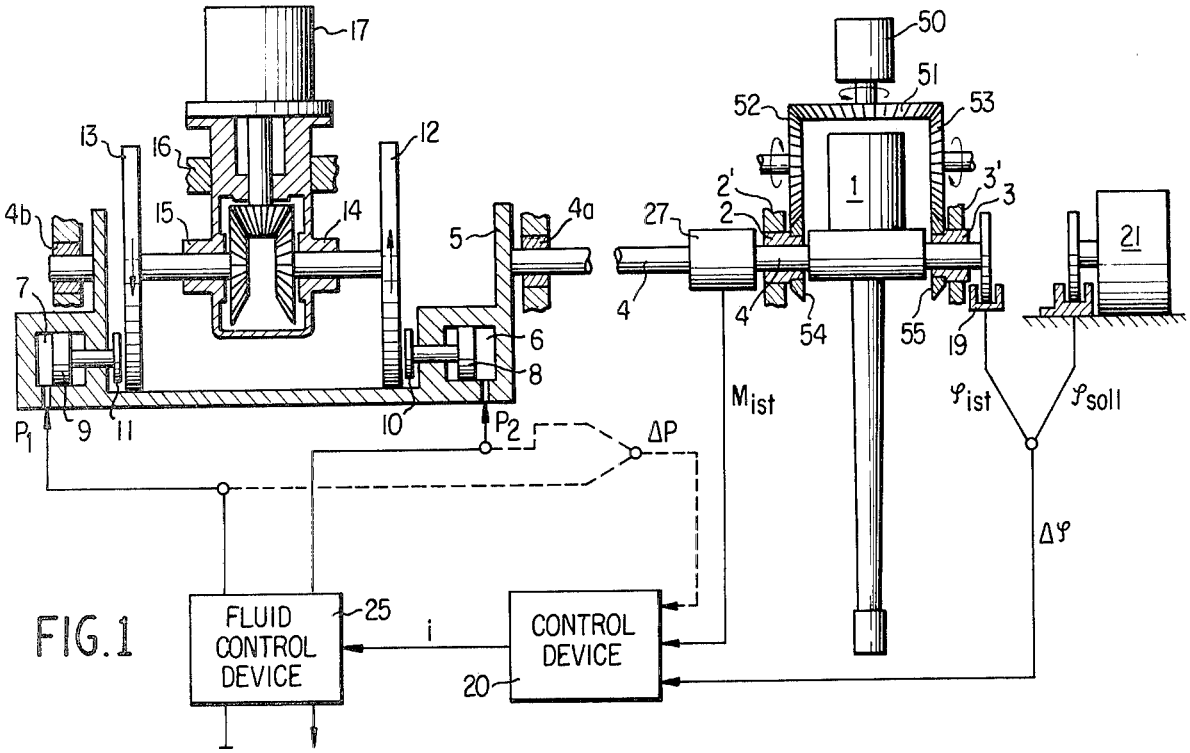
FIG. 1 is a schematic view of the single degree of freedom embodiment of the present invention.

In FIG. 1, the barrelled weapon is fixedly connected to a shaft 4 which may be rotated around angle $\phi$ and is supported via inner bearings 2 and 3 on the body (not shown) of a tracked vehicle. Every bearing has two concentric bearing boxes, one of which is constantly driven opposite to the driven bearing box of the other bearing. Thus, the inner bearings or sleeves 2 and 3 are disposed to be rotated within stationary bearings 2' and 3', respectively, in opposite directions. The drive is from motor 50, which may be electric or hydraulic, for example. The motor drives bevel gear 51 which drives gears 52 and 53 for engaging bevel gears 54, 55 on sleeves 2 and 3 to rotate them. This assures that when the barrelled weapon 1 is being turned, only the hyrodynamic bearing friction has to be overcome. This friction is much smaller than the limit or mixed friction in the starting area and largely independent of the turning speed.

A brake saddle 5 is firmly connected with the turning shaft 4 of the barrelled weapon 1. The brake saddle has in each side a cylinder 6,7 with a piston positioned therein 8,9, each of which can activate a friction cushion 10, 11. The friction cushions 10, 11 have an effect on the brake disks 12, 13 which are supported by the body (not shown) at 14, 15 where they can be rotated, the brake disks 12, 13 are constantly driven in opposite directions, via a bevel drive designated in its entirety by reference 16, by a drive designated in its entirety with the reference 17, for instance a hydraulic drive. The bearings for the shaft 4 and its extension, **4*a* and 4*b*, are preferably of the same low-friction construction used for bearings 2, 2' and 3, 3'**.

Figure 2:
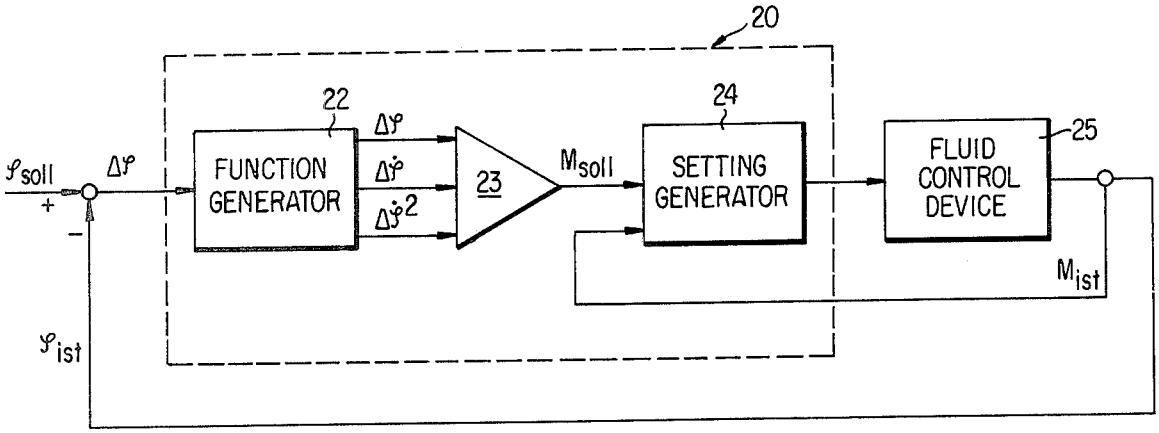
FIG. 2 is a more detailed schematic drawing of a control device that may be used in the FIG. 1 embodiment.

The friction cushions 10, 11 can be activated to achieve defined direction momentums upon the turning shaft 4 of the barrelled weapon 1, by pressure impact of its pistons 8, 9, under hydraulic pressures $p_1$, $p_2$. This activation occurs in dependence on a deviation of the intended direction of the barrelled weapon 1 by means of the control installation 20 indicated in FIG. 1, and the regulating installation shown in detail in FIG. 2. The intended direction of this regulating installation is, for example, provided by an optical target setting device 21, which indicates a direction angle $\phi_{soll}$, representing the desired angle for the weapon. This direction angle $\phi_{soll}$ is compared with the momentary direction angle $\phi_{ist}$ of the barrelled weapon 1, measured at 19. The difference $\Delta\phi$ between these two values $\phi_{soll}$ and $\phi_{ist}$ is the deviation $\Delta\phi$. $\Delta\phi$ represents an initial magnitude for the control installation 20. According to FIG. 2 representing the control installation 20, $\Delta\dot{\phi}$ and $\Delta\dot{\phi}^2$ is formed in a function generator 22 of a construction known in the art (c. F. Heinz Schink "Fibel der Verfahrensregeltechnik" Oldenbourg, Munchen, 1971, Bild 232 and 233 on page 193 and Bild 238 on page 199 and corresponding text). The magnitudes $\Delta\phi$, $\Delta\dot{\phi}$ and $\Delta\dot{\phi}^2$ are combined in a summing member 23 in accordance with a given function to form the intended momentum $M_{soll}$, i.e. $M_{soll}=K_1\Delta\phi+K_2\Delta\dot{\phi}+K_3\Delta\dot{\phi}^2$ wherein $K_1$, $K_2$, $K_3$ are constants which may be chosen according to the particularities of the application. For instance with a system designed for the application in a tank, $K_1=\geqq 1$, $K_2$=approximately $0.1\cdot K_1$, and $K_3$=approximately $\frac{1}{2}\Delta\phi_{max}\cdot K_1\cdot\Delta\phi$ max is equal to the maximum angular acceleration and dependent on the maximum friction moment in either direction and the inertia of the weapon.

This nominal momentum is an initial magnitude for a control element or setting generator 24 of a construction known in the art, (c.f.V. del Toro, S. R. Parker "Principles of Control Systems Engineering" McGraw Hill, N.Y., 1960, FIG. 19 on page 17, FIG. 4–15 on page 118 and corresponding text), which generator is given as second initial magnitude the momentum $M_{ist}$, measured in the regulation circuit behind the fluid control or setting device 25. From $M_{soll}$ and $M_{ist}$ there is formed a setting magnitude i, which is conducted to the setting device 25.

The setting device 25 may be constructed as described and shown in "Technical Bulletin 106" of MOOG Servocontrols, Inc., East Aurora, N.Y. and includes a valve arrangement which brings pressure, depending on the movement direction of the turning of the barrelled weapon 1 which is to be achieved, on piston 8 or 9 of the friction cushion 10 or 11. This is a hydraulic pressure, which is fed by a pump via a control valve to the respective piston space in either cylinder 6 or 7, and which is conducted away via a constant throttle to a tank. By pressing the appropriate friction cushion to the applicable disk, a reaction momentum which is independent of the turning speed of the disk is transferred via the saddle 5 to the swinging shaft 4 of the barrelled weapon 1 in order to accelerate it to a motion which makes $\Delta\phi$ smaller. This actual momentum is continuously measured by means of a power measuring box 27 and is fed back to the setting generator 24 (FIG. 2) of the regulating installation (2), where a new setting signal i is formed depending on the difference $M_{soll}$-$M_{ist}$, which may cause the other piston 9 or 8 to contact the other disc and thereby brake the saddle 5 and thereby the barrelled weapon 1, with diminishing pressures just to the moment when $\Delta\phi=0,\Delta\dot{\phi}=0$, i.e. the barrelled weapon is adjusted in the correct aim. Alternatively it is possible that instead of the actual momentum $M_{ist}$ the difference $\Delta p$ in the actual pressures $p_1$ or $p_2$ in the cylinder 6 or 7 is fed back to the regulating installation 20 (represented in FIG. 1 additionally by dotted lines).

By feeding back the actual momentum, respectively the actual pressure, it is possible to linearize for instance the non-linear characteristics of the setting installation, due to friction value changes because of varying temperatures. Stated more precisely, the characteristic of the valve arrangement is linearized by the pressure being carried back, while the momentum being carried back compensates additionally for friction value changes. The settings brought about with the device according to the invention are independent of the pitching angle of the base and may be adjusted in infinite variation by changing the adherence pressure of the friction cushions.

In common installations, forces or momentums between moving parts through speeding or delaying of masses, for instance of the rotors in motors or of oil masses, are produced in an oil motor. This is connected with a time delay which cannot occur with the invention. The delay time which occurs between the time the setting signal is given and the friction cushion is applied to the disk, is minimal because of the short distance to be traversed and the rapid progress of the pressure in the hydraulic pressure substance.

Due to the auxiliary regulating circuit with the back feeding of the actual momentum, respectively the actual pressure, the non-linear quantities, such as changes in the friction magnitude, due to temperature changes, remain without influence on the regulation of the momentum.

The device according to the invention is placed in operation only when disturbances occur because the positioning and control means couple the base and weapon only when a correction is being made and support for the weapon is through low friction bearings which permit the inertia of the weapon to maintain it in substantially the same angular position despite movements of the base. This contrasts with prior art devices where the weapon follows movements of the base because of the manner of its support thereon and there is continuous interconnection between the weapon and the base through at least portions of the positioning and control structure.

Moreover, the heavy barrelled weapon as traditionally used in tanks and ships is supported on low friction bearings in a manner to be mounted for pivotal movement about the bearing axis. In circumstances where the barrelled weapon is being continuously aimed while the carrier vehicle is subjected to movements such as illustrated in FIG. 3, the massive barrel is permitted to float and thus tends to maintain its aim notwithstanding abrupt changes in platform tilt. Such correcting action as is necessary requires only a very small amount of energy as compared with the prior art where there is a continuous interconnection between the weapon barrel and its supporting base. The correcting action therefore can be supplied by friction pads that are forced against oppositely rotating disks, and this construction is made comparatively simple when the friction pads are supported on shafts mounted for reciprocating movement in parts secured to move with the gun barrel.

The present embodiment of the invention is to be considered as illustrative and not restrictive, the scope of the invention being indicated by the appended claims rather than by the foregoing description, and all changes which come within the meaning and range of equivalency of the claims are therefore intended to be embraced therein.

We claim:

1. A system for positioning and stabilizing the aim of a barrelled weapon on a carrier subject to movement over an uneven supporting surface comprising:

base means supported on said carrier for movement therewith;

bearing means supporting said weapon on said carrier for pivot movement about the axis of said bearing means in such manner that inertia of said barrelled weapon normally maintains said weapon in a preselected aiming position in one degree of freedom despite movement of the carrier in that degree of freedom;

positioning means for controlling the aim of said weapon in said degree of freedom comprising:

a first means including driven means and a second means normally uncoupled to said first means but selectively couplable thereto to be driven in either of opposite directions thereby, said first means including a pair of axially aligned disks mounted for rotation in opposite directions and said second means including a pair of friction pads mounted for individual actuation depending upon the direction of corrective movement desired, said first means being supported on one of either said barrelled weapon or said base means, and said second means being supported on the other of said barrelled weapon or said base means so that said first and second means are normally supported solely by said bearing means to allow free pivotal movement between said weapon and said base means in said one degree of freedom;

means to represent the desired aim of said weapon on said base means in said degree of freedom; and, means responsive to a difference between the desired aim and the actual position of the weapon on said base means in said degree of freedom for coupling said first means and said second means of said positioning means during only such periods as are necessary to bring said weapon to the desired position in said degree of freedom.

2. The system of claim 1 wherein said bearing means includes low friction bearings providing substantially the sole support for said weapon.

3. The system of claim 1 wherein said pair of disks is mounted on the carrier and each of said pair of friction pads are supported on shafts mounted for reciprocating movement in a member rigidly secured to move with said weapon barrel.

4. The system of claim 3 wherein the bearing means supports the weapon for pivot movement about a substantially horizontal axis whereby said free movement of said weapon barrel is in a vertical plane.

5. A system for positioning and stabilizing a barrelled weapon on a carrier subject to movement on an uneven supporting surface comprising:

bearing means on a carrier normally supporting said weapon for pivotal movement on the carrier in such manner that the inertia of said weapon normally maintains said weapon in a preselected aiming position in a plane perpendicular to the pivot axis of said weapon despite movement of the carrier; and, positioning means for controlling the angular position of said weapon about said pivot axis relative to said carrier, said positioning means comprising:

a first continuously moving means and a second means normally uncoupled from said first means but selectably couplable thereto to be driven in either of opposite directions thereby to change the angular position of said barrelled weapon, said first means of said positioning means includes a pair of axially aligned disks mounted for rotation in opposite directions and said second means thereof includes a pair of friction pads mounted for individual actuation depending upon the direction of corrective movement desired, said first means being supported on one of either said barrelled weapon or the carrier, and the second means being supported on the other of said barrelled weapon or the carrier, and said first means and said second means being normally uncoupled during which time said weapon is supported from said carrier solely by said bearing means to allow free pivotal movement in said plane of said weapon relative to said carrier.

6. The system of claim 5 wherein said pair of disks is mounted on the carrier and each of said pair of friction pads are supported on shafts mounted for reciprocating movement in a member rigidly secured to move with said weapon barrel.

7. The system of claim 5 wherein the bearing means supports the weapon for pivot movement about a substantially horizontal axis whereby said free movement of said weapon barrel is in a vertical plane.

* * * * *